United States Patent [19]

Smith

[11] Patent Number: 5,050,421

[45] Date of Patent: Sep. 24, 1991

[54] HAND TOOL FOR FASTENING A TERMINAL IN AN INSULATOR

[75] Inventor: Kenneth Smith, Richman, Tenn.

[73] Assignee: Adams Industries, Inc., Cookeville, Tenn.

[21] Appl. No.: 476,702

[22] Filed: Feb. 8, 1990

[51] Int. Cl.[5] ..... H01R 43/042

[52] U.S. Cl. ..... 72/409; 29/751

[58] Field of Search ..... 72/410, 409, 416; 29/751, 753; 81/418, 421

[56] References Cited

U.S. PATENT DOCUMENTS

| | | | |
|---|---|---|---|
| 2,230,663 | 2/1941 | Alden | 29/751 |
| 3,487,524 | 1/1970 | Filia | 72/410 |
| 3,633,400 | 1/1972 | Wunder | 72/410 |
| 3,680,352 | 8/1972 | Wunder | 72/410 |
| 3,706,219 | 12/1972 | Hoffman et al. | 72/410 |
| 4,080,820 | 3/1978 | Allen | 72/410 |
| 4,386,461 | 6/1983 | Plummer | 29/751 |
| 4,480,385 | 11/1984 | Dragisic | 29/753 |
| 4,534,107 | 8/1985 | Maack | 72/410 |
| 4,637,242 | 1/1987 | Undin | 72/410 |

FOREIGN PATENT DOCUMENTS

| | | | |
|---|---|---|---|
| 257147 | 6/1988 | German Democratic Rep. | 29/753 |

*Primary Examiner*—Daniel C. Crane

*Attorney, Agent, or Firm*—Dickinson, Wright, Moon, Van Dusen & Freeman

[57] ABSTRACT

A hand tool for holding a terminal in an insulating terminal block includes first and second jaws pivotally connected to each other, a channel or receiving the end portion of the terminal in a nose portion of the first jaw and a member attached to the second jaw for deflecting a tabbed portion extending outwardly from the end portion of the terminal so that the terminal is held in the insulator. The end of the terminal is entered in the receiving channel in the first jaw and the jaws are pivoted to a closed position. The tabbed portion of the terminal is deflected to prevent withdrawal of the terminal from the terminal block.

4 Claims, 2 Drawing Sheets

HAND TOOL FOR FASTENING A TERMINAL IN AN INSULATOR

FIELD OF THE INVENTION

This invention relates to a hand tool for fastening a terminal through a slot in a terminal block.

BACKGROUND OF THE INVENTION

Known tools do not address the problem of fastening a terminal through a terminal block by deflecting tab portions adjacent the terminal block, using a hand tool.

Hoffman, et al., U.S. Pat. No. 3,706,291, discloses a pliers-type tool in which a part to be crimped is placed directly between the jaws, perpendicularly to the length of the handle. The device is directed to crimping a ferrule onto a tube. Yeiser, U.S. Pat. No. 3,000,422, describes a tool for crimping a connector to a shielded cable. The workpiece may be crimped in a longitudinal or radial direction, between jaws which pivot at pivot pins. A fixed slot for receiving a terminal is not disclosed.

The patent to Filia, U.S. Pat. No. 3,487,524, describes a crimping tool for an electrical connector, or terminal, having a pair of cooperating crimping dies. The connector or terminal is of the ferrule type for crimping about a wire. The crimping tool receives the part to be crimped perpendicularly to the length of the tool. Wunder, U.S. Pat. No. 3,680,352, describes a crimping tool which receives the part to be crimped at the nose of the tool.

Plummer, U.S. Pat. No. 4,386,461, describes a ribbon connector tool in which the jaws are shaped for crimping a connector to a ribbon cable. The patent to Allen, U.S. Pat. No. 4,080,820, describes an end-line crimping tool having a U-shaped die holder connected to pivotally joined arms such that closing the handle end of the arms crimps an object interposed between the die and a rim mounted on the arm of the pivot. The crimping tool of Allen has pliers-type arms pivotally connected adjacent the ends, and is not readily adaptable for crimping a terminal into an insulator.

None of these patents discloses a device as described and claimed below.

SUMMARY OF THE INVENTION

A hand tool for fastening a terminal in a terminal block includes first and second jaws pivotally connected to each other, a channel for receiving the end portion of the terminal in a nose portion of the first jaw and a member attached to the second jaw for deflecting a tabbed portion extending outwardly from the end portion of the terminal so that the terminal is held in the insulator. The end of the terminal is entered longitudinally in the receiving channel in the first jaw and the jaws are pivoted to a closed portion. The tabbed portion of the terminal is deflected prevent withdrawal of the terminal from the terminal block.

It is an object of the invention to provide a hand tool for deflecting tabbed portions of a terminal.

It is a further object of the invention to provide a hand tool for deflecting tabbed portions of a terminal for fastening the terminal to a terminal block.

DETAILED DESCRIPTION OF THE INVENTION

A hand tool of the invention readily deflects locking tabs of a male quick-connect terminal which has been inserted through an electrical insulating terminal block, thus securing the terminal to the block. The pliers-type action of the tool, coupled with the unique shape of the receptacle and deflecting member on the mating jaws of the tool allows the locking tabs to be deflected, with minimal effort, to retain the terminal in the insulator block. The portability and adaptability of the tool allows it to be used on a variety of terminal configurations. A hand tool of the invention is portable and may equally well be used on an assembly line or for service and maintenance work.

The hand tool is used for clinching or fastening a terminal into an insulating block. A terminal is manufactured to fit through a slot in an insulating terminal block, and the end of the terminal must be secured as it emerges from the insulating block. This is conveniently effected by providing the terminal with tabs extending outward from the forward end portion of the terminal so that the end portion and tabs pas through the slot in the insulating block. After the tabs emerge from the block, they are bent out of the plane of the terminal end portion using a tool of the invention.

Figure 1:
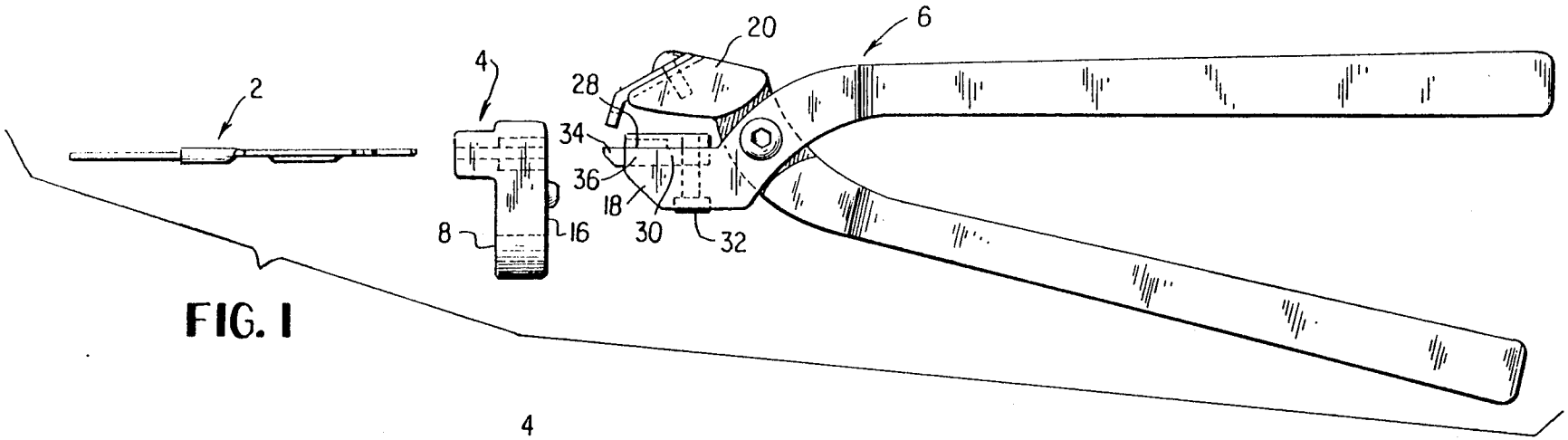
FIG. 1 is a side elevational view of a terminal crimper, insulator and terminal of the invention, ready for use.
Figure 2:
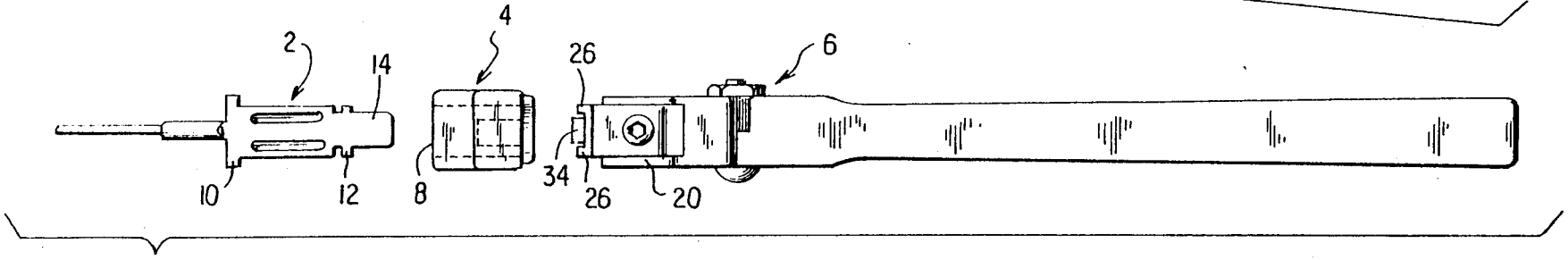
FIG. 2 is a top plan view of FIG. 1.
Figure 3:
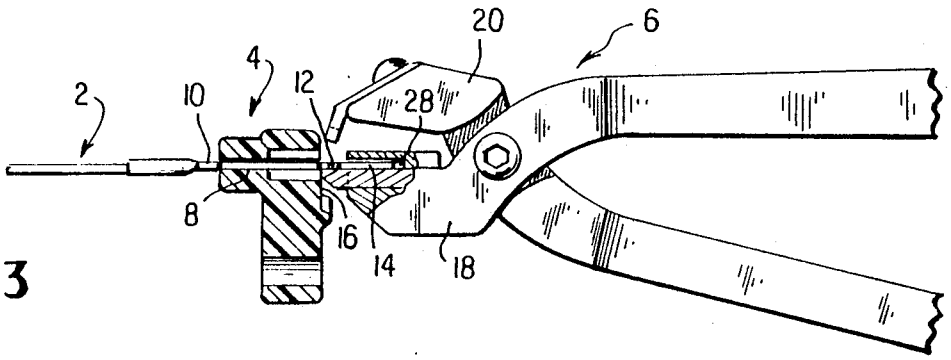
FIG. 3 is a side elevational view, partly in cross-section of a device of FIG. 1 in position before crimping the terminal.

With reference to the Figures, in which like numerals represent like parts, FIG. 1 illustrates terminal 2, insulating terminal block 4 and hand tool 6 in position ready for insertion of terminal 2 through insulator 4, to be crimped by tool 6. FIG. 2 shows a top view of the apparatus of FIG. 1. Terminal 2, is sized to fit through opening 8 in terminal block 4, as shown in FIG. 3. Terminal 2 enters opening 8 as far as projections 10, which prohibit further forward movement of the terminal through the insulator. Tabs 12 and end portion 14 extend from the opposite side of opening 8 of insulator block 4 when terminal 2 is inserted as far as projections 10. Tabs 12 may be coplanar with end portion 14. Opening 8 may be any appropriate configuration.

Figure 4:
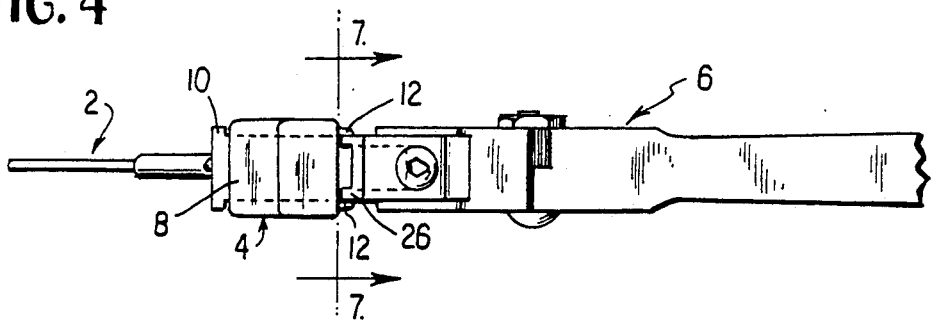
FIG. 4 is a top view of a device of FIG. 3.

Hand tool 6 is then positioned adjacent terminal block 4 with end portion 14 of the terminal inserted in receptacle 30 and jaws 18 and 20 of tool 6 are closed, thus deflecting tabs 12 and preventing withdrawal of the terminal from the insulator. FIG. 4 shows tool 6 in position before closing the jaws. Tabs 12 are visible adjacent wall 16 of insulator 4 when terminal 2 is in position for clinching to the insulator.

Figure 7:
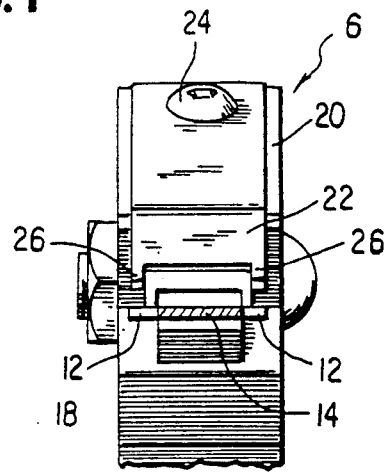
FIG. 7 is a cross-sectional view taken on line 7—7 of FIG. 4.
Figure 8:
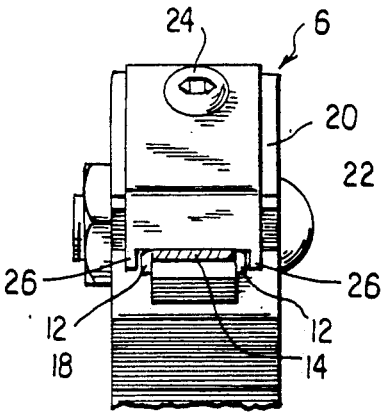
FIG. 8 is a cross-sectional view taken on line 8—8 of FIG. 6.

FIG. 7 shows U-shaped deflecting plate 22 which is secured to upper jaw 20 by screw 24. Deflecting portions 26, which are formed by legs of the U-shaped forward portion of plate 22 cooperate to bend tabs 12 downward, as shown in FIG. 8, which illustrates hand tool 6 in closed position.

Figure 5:
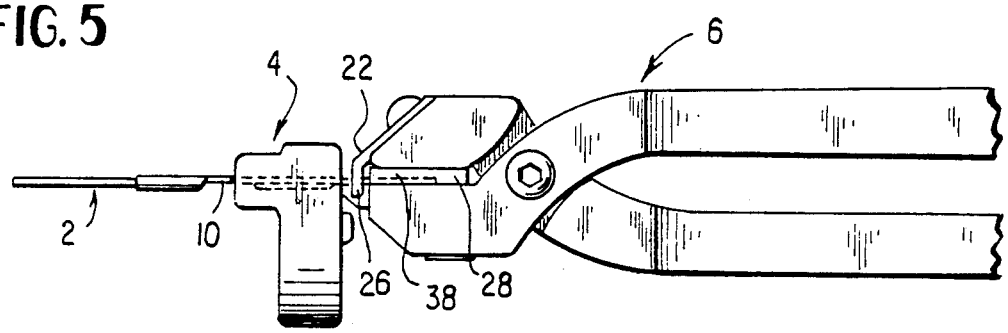
FIG. 5 is a side elevational view of a device of FIG. 4 immediately after crimping the terminal.
Figure 6:
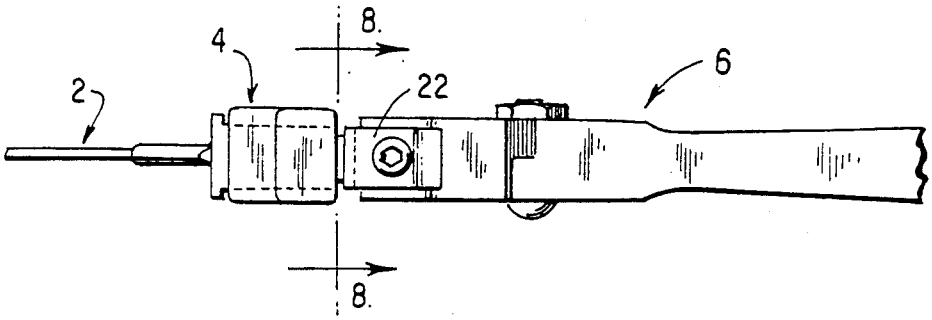
FIG. 6 is a top view of FIG. 5.

In order to position the terminal, terminal 2 is inserted through terminal block 4 and, as shown in FIGS. 3 and 5, inserted into cavity 28 in receptacle 30 attached to lower jaw 18 by screw 32. Receptacle 30 includes support 34, clearly shown in FIG. 1, which guides and supports terminal 2 as it enters cavity 28 in receptacle 30. Deflecting portions 26 of plate 22 attached to upper jaw 20 bend tabs 12 on either side of support 34 when jaws 18 and 20 are closed.

Receptacle 30 preferably fits into a cavity 36 in lower jaw 18, though it may also be positioned on the surface of the jaw. Receptacle 30 is illustrated, in a preferred embodiment, as a closed receptacle having an upper surface 38. Upper surface 38 helps to position terminal end 14 in opening 28 of receptacle 30. Surface 38 may be omitted if receptacle 30 is an open channel.

In use, terminal 2 is inserted through opening 8 in terminal block 4, tool 6 is positioned adjacent surface 16 of terminal block 4 by inserting end 14 of terminal 2 into opening 28 of receptacle 30 of tool 6. Jaws 18 and 20 are closed adjacent surface 16 of insulator 4, thus bending tabs 12, by pressure from leg portions 26, on either side of support 34. The motion of the tool in clinching the terminal in a terminal block may be repeated several times in succession, as on an assembly line, rapidly and efficiently. Each terminal is fastened securely in a terminal block.

While the invention has been described above with respect to certain embodiments thereof, it will be appreciated that variations and modifications may be made without departing from the spirit and scope of the invention.

What is claimed is:

1. A hand tool for securing a terminal through a slot in a terminal block, said terminal comprising an end portion and a substantially coplanar tabbed portion to be deflected, said hand tool comprising:

first and second jaw members pivotally connected to each other;

means for receiving the end portion of the terminal extending through the slot in the terminal block in a nose portion of said first jaw member with a longitudinal axis of the terminal substantially perpendicular to the pivotal axis between said first and second jaw members, wherein said receiving means comprises a channel having an open end of width greater than that of the end portion of the terminal received wherein but less than the width of the tabbed portion to be deflected;

means having a width substantially equal to that of said terminal end portion adjacent said open end for supporting said terminal; and means having a width substantially equal to that of said tabbed portion for deflecting said tabbed portion of the terminal, said deflecting means being secured to said second jaw member;

wherein the end portion of the terminal is longitudinally entered in said receiving means in said first jaw and said jaws are pivoted to a closed position, wherein said deflecting means deflects the tabbed portion of the terminal away from the plane of the end of the terminal and the terminal is fastened to the insulator preventing withdrawal of the terminal therefrom.

2. A hand tool according to claim 1 wherein said receiving means fits into a cavity in said first jaw member.

3. A hand tool for securing a terminal through a slot in a terminal block, said terminal comprising an end portion and a tabbed portion to be deflected, said hand tool comprising:

first and second jaw members pivotally connected to each other;

means in said first jaw member fitted into a cavity in said first jaw member for receiving an end portion of the terminal;

second jaw means for deflecting the tabbed portion of the terminal;

wherein said end portion of the terminal extending through the slot in the terminal block is longitudinally entered in said receiving means perpendicularly to the pivotal axis between said first and second jaw members and said jaws are closed, whereby said deflecting means bends said at least one tab of the terminal out of the plane of the end portion and said terminal is secured in position through the terminal block.

4. A hand tool according to claim 3 comprising means for removing and replacing the receiving means.

* * * * *